US005142997A

United States Patent [19]

DeLong et al.

[11] Patent Number: 5,142,997

[45] Date of Patent: Sep. 1, 1992

[54] PROJECTILE RESISTING SPACE DIVIDING SYSTEM

[75] Inventors: Ronald B. DeLong, Belmont; Michael W. Worthington, Big Rapids; Floyd L. Cook, Jr., Muskegon Heights, all of Mich.

[73] Assignee: Westinghouse Electric Corp., Pittsburgh, Pa.

[21] Appl. No.: 607,421

[22] Filed: Oct. 31, 1990

[51] Int. Cl.[5] ..... E06B 9/00

[52] U.S. Cl. ..... 109/49.5; 109/10; 109/82; 52/239

[58] Field of Search ..... 109/49.5, 9, 10, 21.5, 109/26, 58, 65, 74–85; 52/238.1, 239

[56] References Cited

U.S. PATENT DOCUMENTS

| | | | |
|---|---|---|---|
| 1,899,735 | 2/1933 | McClintock | 109/21.5 X |
| 2,015,868 | 10/1935 | O'Kieffe | 109/10 |
| 3,382,821 | 5/1968 | Dundr . | |
| 3,762,116 | 10/1973 | Anderson et al. . | |
| 3,815,312 | 6/1974 | Lench | 109/82 X |
| 3,872,804 | 3/1975 | Yarnall | 109/49.5 |
| 4,061,093 | 12/1977 | Carstens, Jr. et al. . | |
| 4,186,648 | 2/1980 | Clausen et al. . | |
| 4,198,454 | 4/1980 | Norton . | |
| 4,292,882 | 10/1981 | Clausen . | |
| 4,296,579 | 10/1981 | Proud | 52/239 |
| 4,446,663 | 5/1984 | Stumpf et al. | 52/239 X |
| 4,571,906 | 2/1986 | Ashton | 52/239 |
| 4,598,647 | 7/1986 | Biedess . | |
| 4,601,137 | 7/1986 | Bates | 52/239 X |
| 4,625,659 | 12/1986 | Saelzer | 109/49.5 |
| 4,635,417 | 1/1987 | LaRouche | 52/239 |
| 4,678,702 | 7/1987 | Lancaster et al. . | |
| 4,709,659 | 12/1987 | Quante, III et al. . | |
| 4,748,790 | 6/1988 | Frangolacci | 109/49.5 X |
| 4,822,657 | 4/1989 | Simpson . | |
| 4,854,248 | 8/1989 | Salzer | 109/49.5 X |
| 4,896,613 | 1/1990 | Salzer | 109/49.5 X |
| 4,919,037 | 4/1990 | Mitchell | 109/49.5 X |
| 4,949,518 | 8/1990 | Nagel et al. | 52/239 |
| 4,962,710 | 10/1990 | Habicht et al. | 109/49.5 X |
| 5,004,286 | 4/1991 | Taylor et al. | 109/9 X |

*Primary Examiner*—Renee S. Luebke
*Assistant Examiner*—Suzanne L. Dino
*Attorney, Agent, or Firm*—D. R. Lackey

[57] ABSTRACT

A space dividing system which comprises a rectangular panel having a metallic frame which includes stiles and rails arranged to form a window. The stiles and rails each have a channel which faces the window and first and second spaced internal pockets which straddle the channel. Projectile resistant material is disposed in the first and second pockets of each stile, and a rigid rectangular layer of projectile resistant material is centered in the frame window with its outer edges extending into the channels and overlapping the first and second pockets. In a preferred embodiment, layers of acoustical insulation are respectively disposed against opposite sides of the rigid layer of projectile resistant material; and, the panel is supported by an arrangement which includes both a hollow metallic post filled with projectile resistant material, and a connecting joint structure which both blocks and deflects projectiles entering the joint.

18 Claims, 4 Drawing Sheets

FIG. 1A.
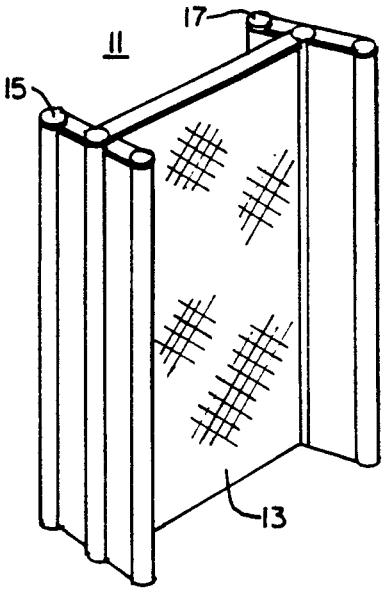
FIG. 5.
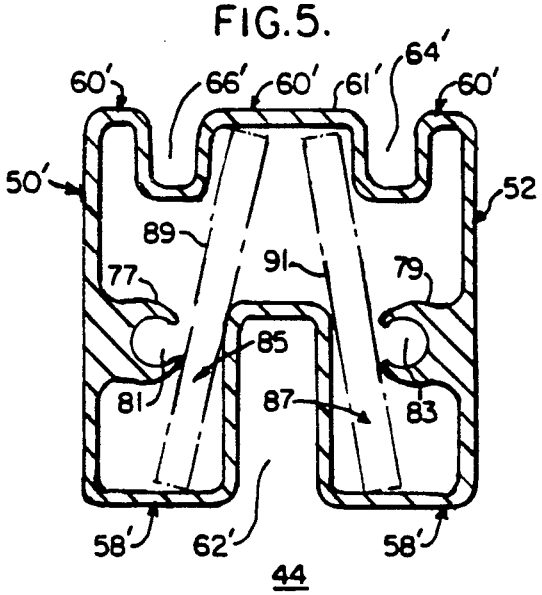
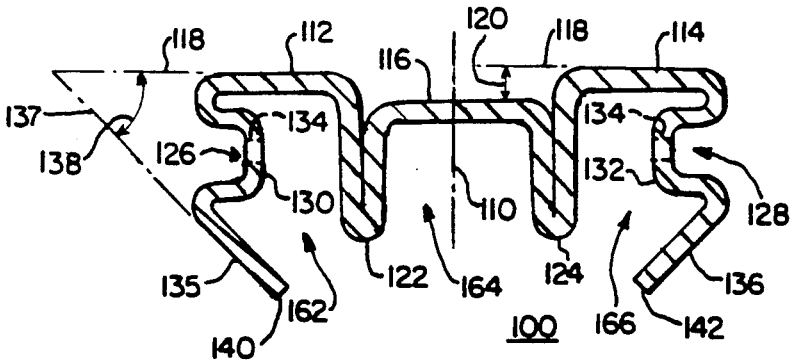
FIG. 6.
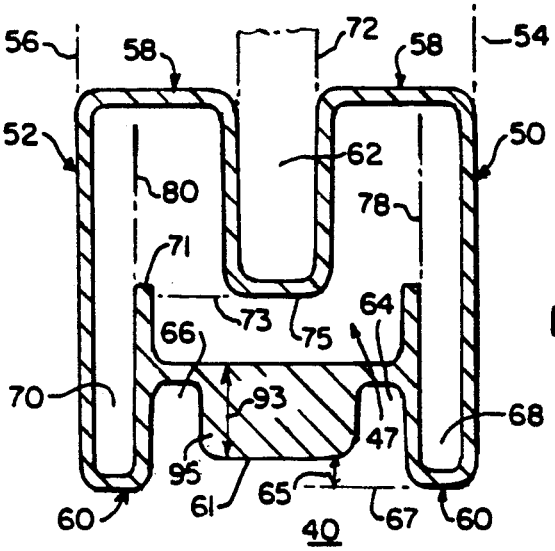
FIG. 4.

PROJECTILE RESISTING SPACE DIVIDING SYSTEM

TECHNICAL FIELD

The invention relates in general to space dividing systems where personnel security is required or desired, such as space dividing systems for government and military offices, banks, mail rooms, airport baggage security areas, and the like, and more specifically to space dividing systems which are resistant to projectiles, such as bullets, bullet fragments, and bomb fragments.

BACKGROUND ART

Light weight, non-metallic materials having the capability of resisting bullets, bullet fragments, shrapnel, and the like, have been developed in recent years, which have the capability of being used both in garments and in rigid forms. It would be desirable and it is an object of the present invention to effectively apply this technology to the space dividing system art in a manner which does not deleteriously affect the appearance and weight of such systems.

SUMMARY OF THE INVENTION

Briefly, the present invention is a new and improved space dividing system which includes a substantially rectangular panel having the size, shape, appearance and approximate weight of a standard panel of an office space dividing system. The panel includes a metallic frame having frame elements which define a window. The frame elements each include a centrally located channel which faces the frame window, with the channels collectively defining a continuous annular channel. The frame elements further include first and second spaced internal pockets which straddle the associated channel.

A rigid layer of projectile resistant material is disposed in the frame window, with its perimetrical edges extending into the annular channel. Projectile resistant material is also disposed in the first and second pockets of at least the vertically oriented frame elements, such that the material, which may also be in the form of rigid layers, overlaps the edges of the rigid layer.

A layer of acoustic insulation is disposed against each major side of the rigid layer of projectile resisting material, and a decorative fabric covering is disposed on each major side of the panel, concealing and retaining the acoustic insulation.

In a preferred embodiment of the invention, the new panel is supported by a panel connector arrangement which includes a post. A slotted standard is fixed to each of the two vertical edges of the panel, and the slotted standards include hooks for engaging complementary surfaces on a post. Each post is a hollow metallic tubular member, with a dowel formed of a laminated plastic disposed therein, to resist projectiles which strike the post.

The slotted standard-post interface is curved, with the slotted standard having first and second outer flanges which extend towards and terminate in close proximity to the post. The slotted standard has additional flanges between the outer flanges which define open ended channels which face the post. A projectile which strikes an outer flange will cause the flange to bend, absorbing energy, and the curved interface deflects the projectile, and fragments thereof, into the open ended channels.

The joint between each slotted standard and an associated vertical edge of the panel has a tortuous configuration which includes at least one metallic mass, such as an integral portion of one of the elements forming the joint, or an elongated metallic bar disposed in a recess formed by the joint. The at least one metallic mass is disposed at a location which blocks the path of any projectile which may happen to strike the joint.

BRIEF DESCRIPTION OF THE DRAWINGS

The invention will become more apparent by reading the following detailed description in conjunction with the drawings, which are shown by way of example only, wherein:

FIG. 1A is a perspective view of a portable space dividing system which may be constructed according to the teachings invention;

FIG. 4 is an enlarged cross sectional view of one of the frame stiles, constructed according to the embodiment of the invention shown in FIG. 3, illustrating a channel and inner pockets for receiving projectile resistant material;

FIG. 5 is an enlarged cross sectional view of one of the frame rails, illustrating a channel and inner pockets which may receive projectile resistant material;

FIG. 6 is an end view of one of the slotted standards;

DESCRIPTION OF PREFERRED EMBODIMENTS

Figure 1:
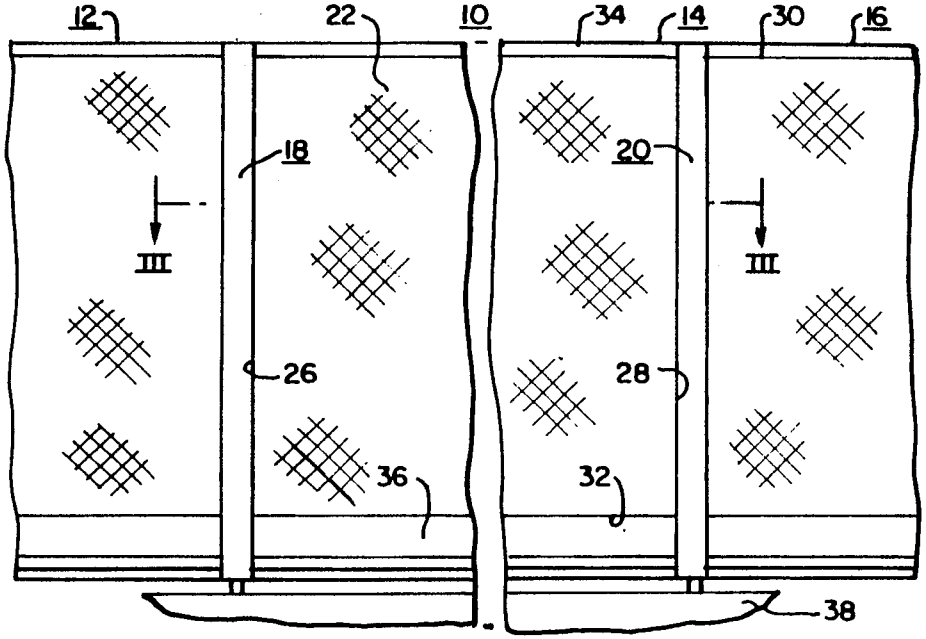
FIG. 1 is an elevational view of a space dividing system which may be constructed according to the teachings of the invention.

Referring now to the drawings, and to FIG. 1 in particular, there is shown a space dividing panel system 10 which may be constructed according to the teachings of the invention. For purposes of example, the space dividing system shown in U.S. Pat. No. 3,762,116, which is assigned to the same assignee as the present application, is modified according to the invention, and from this description it will be obvious to one skilled in the art how other space dividing systems may be modified. Space dividing system 10 includes a plurality of rectangular space dividing panels, such as panels 12, 14, and 16, with a panel connector arrangement 18 interconnecting panels 12 and 14, and with a similar panel connector arrangement 20 interconnecting panels 14 and 16. Space dividing system 10 may have any number of panels disposed in any desired arrangement.

Space dividing system 10 may be of the type such that once installed the panel members retain their installed positions until the system, or parts thereof, are changed, and/or system 10 may include one or more portable panel assemblies, such as portable panel assembly 11 shown in FIG. 1A. Portable panel assemblies are light enough to permit an assembly to be moved to different locations when desired. As indicated in FIG. 1A, portable panel assembly 11 includes a central panel 13 having a relatively narrow width dimension, and it is supported by end sections 15 and 17 which may join the central panel 13 in the same manner as will be hereinafter described relative to panels of system 10 shown in FIG. 1. End sections 15 and 17 have a length dimension just long enough to ensure stability of assembly 11.

Figure 3:
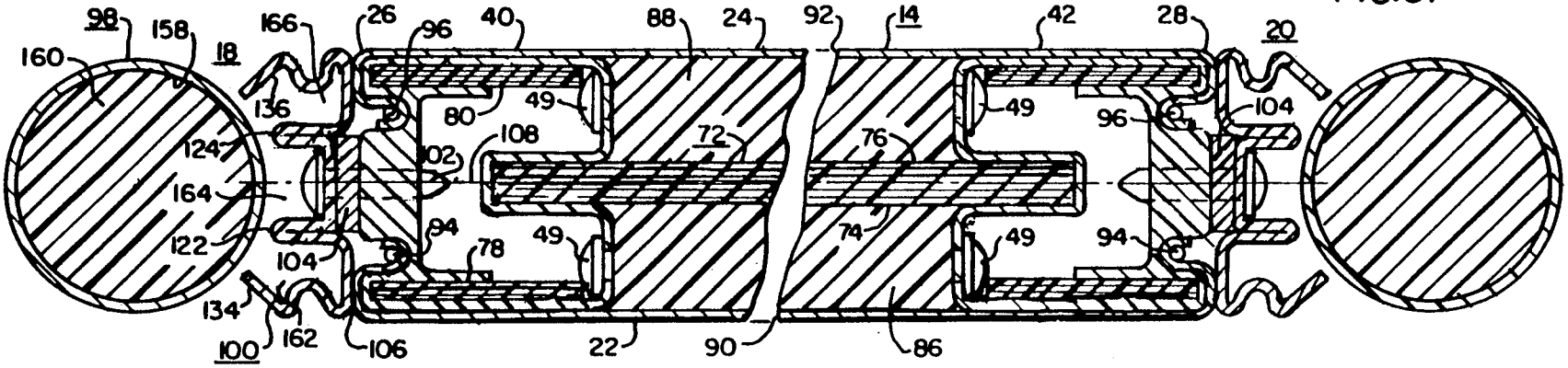
FIG. 3 is a cross-sectional view of the panel system shown in FIG. 1, taken between and in the direction of arrows III—III, which illustrates the teachings of the invention.
Figure 2:
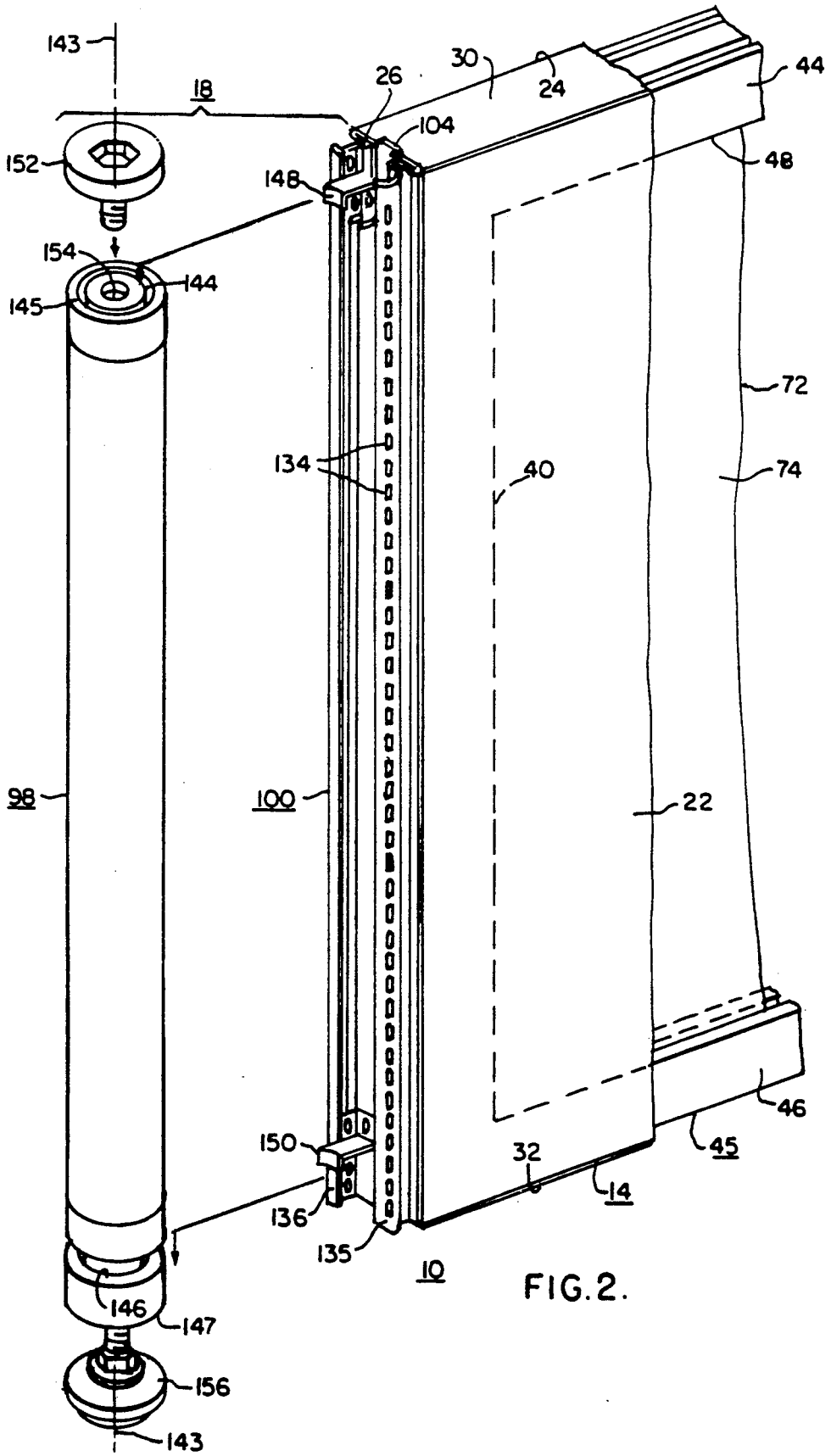
FIG. 2 is a perspective view of a panel and panel connector system constructed according to the invention.

The construction of panel system 10 according to the invention, including both non-portable and portable assemblies, is illustrated in FIGS. 2 and 3. In particular, FIG. 2 is a fragmentary perspective view of system 10 shown in FIG. 1, illustrating the left-hand side of panel 14 and panel connector arrangement 18, and FIG. 3 is a cross sectional view through panel 14 and panel connector arrangements 18 and 20. Since all of the panels and panel connector arrangements of both portable and non-portable assemblies may be of like construction, only panel 14 and connector arrangement 18 will be described in detail.

Panel 14 includes first and second major opposed sides 22 and 24, respectively, first and second vertical edges 26 and 28, respectively, and top and bottom edges 30 and 32, respectively. As shown in FIG. 1, a top cap 34 may be provided on the top of each panel, and a raceway 36 may extend from the bottom edge 32 of each panel to a floor 38.

Panel 14 is constructed of a plurality of tubular metallic frame elements, including first and second vertically oriented stiles 40 and 42 and horizontally oriented upper and lower rails 44 and 46, the ends of which are joined together by suitable fasteners such as screws 49 (FIG. 3) to form a frame 45 having a frame opening or window 48.

FIG. 4 is a cross-sectional view of one of the frame stiles, such as stile 40, with stile 42 being of like construction. Stile 40, which defines an internal longitudinally extending opening 47, includes substantially flat front and back sides or surfaces 50 and 52, with the front and back surfaces of all of the frame elements being respectively disposed in front and back planes 54 and 56. Stile 40 further includes inner facing and outer facing sides 58 and 60, respectively, ie., side 58 faces the frame window 48 and side 60 is on the opposite or outer edge of the frame 45. Inner side 58 includes a relatively deep channel 62 disposed substantially midway between sides 50 and 52, and outer side 60 includes first and second spaced spline grooves 64 and 66, respectively.

First and second inner pockets 68 and 70 are provided within the tubular opening 47 of stile 40, extending from side 58 to side 60 directly adjacent to the inner surfaces of the walls which define the front and back surfaces 50 and 52, respectively. It will be noted that the first and second pockets 68 and 70 straddle the inner channel 62, and that the first and second pockets 68 and 70 overlap channel 62 by a substantial dimension which is about equal to one-half the dimension of frame element 46 measured between the inner and outer sides 58 and 60. The channels 62 of the four outer frame elements cooperatively form a substantially continuous annular channel about the frame window 48.

An intermediate surface 61 on side 60, located between the spline bead channels 66 and 64, is recessed inwardly from a plane 67 to provide a recess 65, as shown in FIG. 4.

Pockets 68 and 70 are partially created by the formation of spline grooves 64 and 66, and also by internal flanges 69 and 71 which extend toward side 58 by a dimension sufficient to overlap the inwardly extending channel 62. In other words, a plane 73 across the lower internal surface 75 of channel 62 intersects the sides of flanges 69 and 71. The recessed central portion defined by surface 61 has a wall 95 which has a substantially thicker wall dimension 93 than the remaining walls of the stile.

FIG. 5 is a cross sectional view of one of the rails, such as upper rail 44, with lower rail 46 being of like construction. Rails 44 and 46 differ from stiles 40 and 42 so the ends of the rails and stiles may be easily joined by screws 49. Portions of rail 44 which may be the same as stile 40 are given the same reference numerals as stile 40, with the addition of a prime mark. Since rails 44 and 46 are at elevated and floor levels, respectively, where projectiles will not normally be of critical concern, there is no need to recess the intermediate surface 61' of side 60', nor is there a need to make the wall thickness of side 60' greater than the thickness of the remaining sides. Further, the internal flanges 69 and 71 are not necessary.

Rail 44 has inwardly extending projections 77 and 79 having C-shaped openings 81 and 83. Openings 81 and 83 and fasteners 49 shown in FIG. 3 are cooperatively selected such that fasteners 49 will enter openings 81 and 83 and firmly grip the surrounding metal defined by extensions 77 and 79. The projections 77 and 79 change the locations of the pockets for receiving projectile resistant material, with rail 44 defining pockets 85 and 87. Pockets 85 and 87 straddle channel 62', extending from side 60' to side 62' in contact with inner corners of channel 62'. Pockets 85 and 87 are tilted slightly from basically a vertical orientation because of the inwardly projecting spline grooves 64' and 66'. Pockets 85 and 87 extend from cavities located between extensions 77 and 79 and channel 62', to an inner channel formed between spline grooves 64' and 66'.

As best shown in FIG. 3, a rigid layer 72 of projectile resistant material is disposed in the continuous annular recess or channel collectively defined by the channels 62 and 62' of the stile and rail frame elements. Rigid layer 72, which has a rectangular configuration, has first and second major opposed surfaces 74 and 76, respectively, and perimetrical edges which fit within the channels 62 and 62' of the first and second stiles 40 and 42 and upper and lower rails 44 and 46. In a preferred embodiment, the edges of layer 72 enter channels 62 and 62' with a slip fit, to allow layer 72 to move or give when struck by a projectile. To insure that such movement will not cause layer 72 to come out of a channel, the depth of channels 62 and 62' should be at least 0.75 inch.

Referring to FIGS. 3 and 4, first and second layers 78 and 80 of projectile resistant material, shown in phantom in FIG. 4, are disposed in the first and second pockets 68 and 70, respectively. The broken outline of the layers 78 and 80 completes the outline of pockets 68 and 70.

Referring to FIG. 5, first and second layers 89 and 91 of projectile resistant material, shown in phantom, may be disposed in first and second internal pockets 85 and 87, if required. Again, the broken outline of layers 89 and 91 define the boundaries of pockets 85 and 87. While it is mandatory that projectile resistant material be disposed in the vertically oriented stiles 40 and 42, it is optional with the horizontally oriented upper and lower rails 44 and 46. Projectiles striking the rails 44 and 46, which are respectively at an elevated level and floor level, may or may not pose a threat, depending upon the specific use, and thus projectile resistant material 89 and 91 is optional in either or both of the rails 44 and 46.

Layers 72, 78, 80, 89 and 91 are preferably rigid layers of projectile resistant material. These rigid layers of projectile resistant material are preferably built up to the desired thickness dimension from a plurality of plies of a unidirectional resin/fiber matrix, with the plies of adjacent layers being oriented at right angles to one another. Such material is available commercially from Allied-Signal Inc. under their registered trademark Spectra, which has light, strong fibers spun from a solution of ultra high molecular weight polyethylene (UHMWPE). With such a material, level IIIA of the National Bureau of Standards STD-0101.01 ballistic hand gun tests are successfully passed when the rigid layer 72 of projectile resistant material has a thickness dimension of only about 0.25 inch, which thickness weighs about 1.13 pound per square foot. Layers 78, 80, 89 and 91 of projectile resistant material disposed in the inner pockets 68, 70, 85 and 87 need only have a thickness dimension of about 0.125 inch.

In a preferred embodiment of the invention, panel 14 has first and second layers 86 and 88 of fiberglass acoustic insulation respectively disposed between the first and second major surfaces 74 and 76 of rigid layer 72 and the outer planes 54 and 56 of panel 14. The fiberglass layers 86 and 88 make the space dividing projectile resistant panels 12, 14 and 16 as good acoustically as conventional space divider panels, and they give the panels a desirable Class A fire rating. The fiberglass panels 86 and 88 are covered with decorative fabric layers 90 and 92, which layers are secured to all four sides of panel 14 via spline beads 94 and 96 and spline grooves 64 and 66.

Panel connector arrangement 18 includes a post 98 and a slotted standard 100, with the disclosed projectile resistant panel construction and arrangement for connecting the slotted standard to a panel, permitting commercially available posts and standards to be used, such as those available from the assignee of the present invention. Slotted standard 100, which is used to support work surfaces, cabinets, and the like, from the panel-based space dividing system 10, is fixed to the first vertical edge 26 of panel 14 via a plurality of suitable fasteners, such as self drilling, self threading screws 102.

An elongated metal bar 104 is centrally disposed in the interface or joint 106 between the edge 26 and the slotted standard 100. The centrally located recess 65 in outer surface 60 of each stile 40 and 42 and a complementary recess 120 in the back of the slotted standard, as will be hereinafter described, enables the metal bar 104 to be centrally disposed in the joint 106 with respect to a horizontally oriented longitudinal axis 108 of the panel 14, as well as with respect to a vertical axis transverse thereto which proceeds through the joint Thus, a projectile which attempts to enter joint or interface 106 will not go straight through the interface to the other side of panel 14, but will be blocked by the centrally located bar 104, which in turn is firmly held and blocked against sideways movement by portions of the slotted standard which extend outwardly on opposite sides of bar 104. When the stiles 40 and 42 are constructed with recess 65 as shown in FIG. 4, the screws 104 which join the slotted standard 100 to the stile may be placed about four inches apart along the length of the slotted standard. If stiles 40 and 42 were to be constructed without recess 65, eliminating the tortuous joint configuration, eg., similar to the un-recessed rail construction shown in FIG. 5, screws 104 would have to be placed much closer together to pass the level IIIA ballistic tests, such as about two inches apart.

Slotted standard 100 has a cross sectional configuration, as best shown in an end view thereof in FIG. 6. Slotted standard 100 is symmetrical about a central axis 110, and it includes a mounting base having first and second lateral sections 112 and 114, joined by a recessed intermediate section 116. The intermediate section 116 is spaced inwardly from a plane 118 which passes through the outer surfaces of lateral sections 112 and 114, to provide the hereinbefore mentioned recess 120. The metal material used to form the slotted standard 100 is folded perpendicularly upward to form first and second flanges 122 and 124 on opposite sides of intermediate base section 116, whose thickness dimensions are twice that of the base metal.

The lateral base sections 112 and 114 rise upwardly and then quickly enter first and second channel shaped sections 126 and 128, respectively, with the channel openings facing laterally outward compared with axis 110. Bases 130 and 132 of the U-shaped sections 126 and 128 each include a plurality of closely vertically spaced slots 134, best shown in FIG. 2. Slotted standard 100 then bends inwardly towards axis 110 at the end of each of the channel shaped sections 126 and 128, forming flanges 135 and 136, respectively. The orientation of flanges 135 and 136 is such that a plane 137 through the flanges would make an angle 138 with plane 118 of about 45 degrees. Ends 140 and 142 of flanges 135 and 136, respectively, extend outwardly from plane 118 by a greater dimension than do flanges 122 and 124, to enable the flanges 135, 122, 124 and 136 to snugly encompass post 98, which in a preferred embodiment of the invention has a round cross sectional configuration.

Post 98 is a hollow, normally empty, metallic tubular structure having a longitudinal axis 143, upper and lower ends 145 and 147, respectively, and annular recesses 144 and 146 positioned to receive hooks 148 and 150, respectively. Hooks 148 and 150 are fixed to slotted standard 100 and the associated stile 40 or 42 of frame 45. A post cap screw 152 engages a threaded axial opening 154 in the upper end 145 of post 98 after panel 14 is supported by post 98, which prevents disassembly, and a leveler support foot 156 engages a threaded axial opening (not shown) in the lower end 147 of post 98. Post 98 has a central opening 158 filled with a projectile resistant material 160. Material 160, because of its thickness, need not be formed from ballistic fabric, as required by the relatively thin layers 72, 78 and 80. For example, a relatively low cost dowel may be used, which is formed, for example, of a laminated plastic comprised of fabric formed of cellulose, glass, synthetic fibers, and the like, and bonded with phenolic or melamine resins at high temperatures and pressures. For example, a material called Micarta, a registered trademark of Westinghouse Electric Corporation, may be used.

As will be noted in FIGS. 3 and 6, the flanges 135, 122, 124 and 136 cooperatively define open ended channels 162, 164 and 166, with the open ends of the channels facing post 98. Post 98 fits snugly into the interface formed by the shorter inner flanges 122 and 124 and the longer outer flanges 135 and 136. The outer flanges 135 and 136 are not folded, but have one thickness of the metal of which the slotted standard 100 is formed, and they bend inwardly when struck by a projectile, which action absorbs energy from the projectile. The slowed projectile, and any fragments therefrom, then strike the curved outer surface of post 98, and if they do not penetrate the metal post and enter the dense, thick material 160, they will be deflected. Deflected fragments are directed by the curved surface of post 98 into open ended channels 162, 164, or 166. The inner flanges 122 and 124 are constructed of folded metallic material and thus have double thickness compared with outer flanges 135 and 136, absorbing a large amount of energy without substantial deformation, and insuring that projectiles will be contained within one of the channels 162, 164, or 166.

Figure 7:
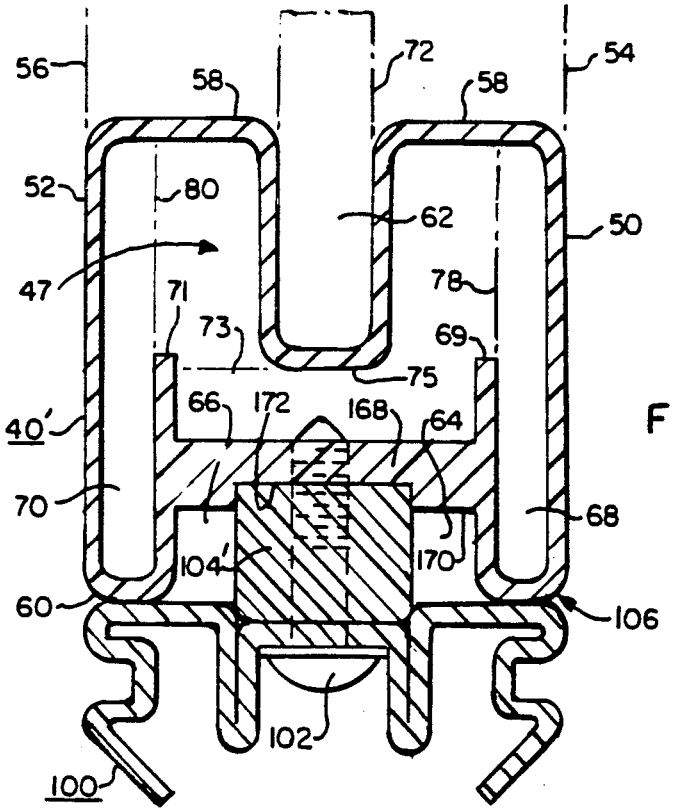
FIG. 7 is an enlarged cross sectional view of one of the frame stiles and associated slotted standard, with the frame stile being similar to the frame stile shown in FIG. 4, except illustrating another embodiment of stile which may be used.
Figure 8:
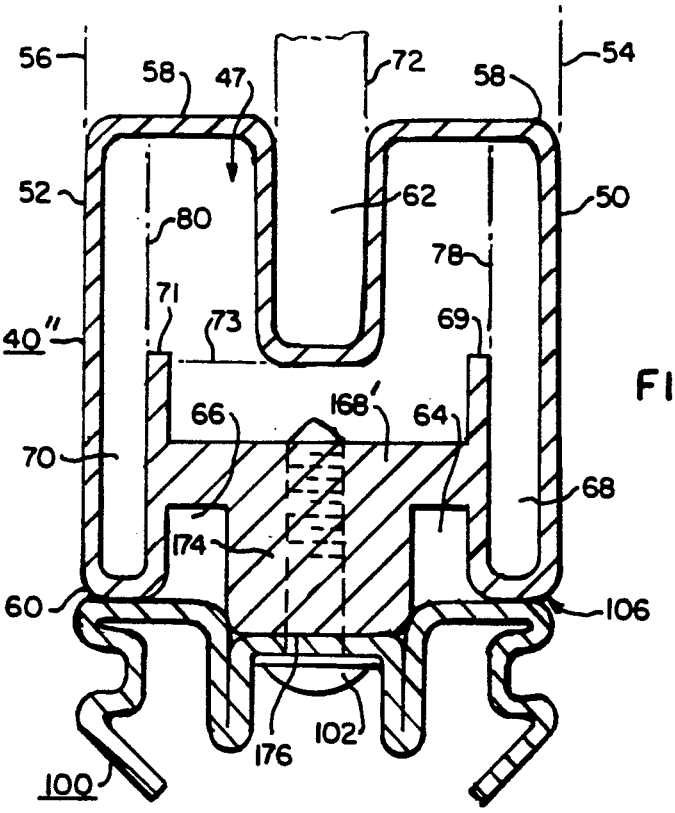
FIG. 8 is an enlarged cross sectional view of one of the frame stiles and associated slotted standard, with the frame stile being similar to the frame stile shown in FIG. 4, except illustrating still another embodiment of stile which may be used.

As hereinbefore described, the joint or interface 106 between slotted standard 100 and a stile 40 or 42 has a tortuous configuration which includes a metallic mass, ie., metallic bar 104 in the FIG. 3 embodiment, to block a projectile which may happen to squarely strike joint 106. FIGS. 7 and 8 illustrate other arrangements for obtaining the tortuous configuration of joint 106, with like reference numerals in the Figures indicating components, and like reference numerals with a prime mark indicating modified components. FIGS. 7 and 8 also illustrate the connecting means or slotted standard 100, but the outer fabrics 90 and 92 and spline beads 94 and 96 shown in FIG. 3 are not shown for clarity.

More specifically, FIG. 7 illustrates an embodiment in which a much larger metallic bar 104' replaces the metallic bar shown in FIG. 3. To accommodate metallic bar 104', which may have a substantially square cross sectional configuration, stiles 40 and 42 shown in FIG. 3 are modified, as shown relative to a stile 40' in FIG. 7, to provide a web 168 between flanges 69 and 71 having a surface 170 which is more deeply recessed inwardly from side 60 than is the recessed surface 61 of stile 40 shown in FIG. 4. Web 168 is also provided with a greater thickness dimension than the remaining wall elements of the stile. Still further, the recessed surface 170 may itself be recessed to provide a surface 172 dimensioned to receive and snugly centrally position elongated metal bar 104'. Metallic bar 104' may be constructed of any suitable metal such as steel or aluminum.

FIG. 8 illustrates an embodiment similar to that of FIG. 7, except illustrating a modified stile. 40' wherein the thickened web 168 of stile 40' is further modified to include an integral projection 174 which provides the function of the elongated metallic rod 104'. Thus, in the embodiment of FIG. 8, instead of having a recess surface, stile 40' includes a projection 174 having a surface 176 which extends outwardly past the remaining surfaces of side 60, directly into the recess 120 defined by slotted standard 100.

In summary, there has been disclosed a new space dividing system in which the panels, and panel-to-panel connectors, are cooperatively integrated to provide a barrier system which is highly resistant to complete penetration by a projectile.

We claim:

1. A space dividing system which resists penetration by projectiles, comprising:

a substantially rectangular panel, said panel having first and second major opposed sides, and first and second vertical edges, said panel including a metallic frame having upper and lower tubular rails and first and second tubular stiles which cooperatively define a window, said upper and lower rails and first and second stiles having substantially flat front and back surfaces disposed in common front and back planes, respectively, inner surfaces which define said window, and outer surfaces, each of said upper and lower rails and said first and second stiles having a configuration which defines a channel in the inner surface, with the channels in the inner surfaces of the rails and stiles cooperatively providing a continuous annular channel about the frame window, each of said first and second stiles further defining first and second inner pockets respectively adjacent to the front and back surfaces, projectile resistant material disposed in the first and second pockets of each of the first and second stiles, and a rigid layer of projectile resistant material disposed in the frame window, said rigid layer of projectile resistant material having first and second major opposed surfaces and perimetrical edges, with said perimetrical edges projecting into said annular channel, between and overlapping the first and second pockets containing the projectile resisting material.

2. The space dividing system of claim 1 including a metallic post having a cavity, projectile resistant material disposed in and substantially filling the post cavity, and connecting means connecting the panel to said post such that the panel is at least partially supported by said post.

3. The space dividing system of claim 2 wherein the connecting means includes a metallic slotted standard connected to a stile at a vertical edge of the panel via fastening means to define a joint between the slotted standard and stile, and including metallic means disposed in said joint to block a projectile which may enter the joint from either major side of the panel.

4. The space dividing system of claim 3 wherein the metallic means includes an elongated metallic bar.

5. The space dividing system of claim 3 wherein the metallic means includes an integral projection of the stile.

6. The space dividing system of claim 3 wherein the metallic slotted standard has a configuration which defines first and second impact absorbing, bendable flanges which extend from the slotted standard to the post, and a plurality of open channels, and wherein the slotted standard and post cooperatively define a curved interface which deflects projectile entering the interface into an open channel.

7. The space dividing system of claim 1 including first and second layers of acoustic insulation respectively disposed against both the first and second major opposed surfaces of the rigid layer of projectile resistant material.

8. The space dividing system of claim 7 wherein the first and second layers of acoustic insulation include fiberglass.

9. The space dividing system of claim 1 wherein the rigid layer of projectile resistant material has a thickness dimension of at least about 0.25 inch, and it includes a laminated resin-fiber matrix which includes fibers formed of a ultra high molecular weight polyethylene.

10. The space dividing system of claim 1 wherein the projectile resistant material disposed in the first and second pockets of the each stile includes first and second rigid layers, respectively, formed of projectile resistant material having a thickness dimension of at least about 0.125 inch, and each of the first and second rigid layers include a laminated resin-fiber matrix having fibers formed of a ultra high molecular weight polyethylene.

11. The space dividing system of claim 2 wherein the projectile resistant material disposed in the post cavity includes a dowel formed of a laminated plastic material.

12. The space dividing system of claim 1 wherein each of the first and second rails define first and second pockets, and including projectile resistant material disposed in the first and second pockets of the first and second rails.

13. The space dividing system of claim 12 wherein the projectile resistant material disposed in the first and second pockets of the each rail and stile includes first and second rigid layers, respectively, formed of projectile resistant material having a thickness dimension of at least about 0.125 inch, and each of the first and second rigid layers include a laminated resin-fiber matrix having fibers formed of a ultra high molecular weight polyethylene.

14. The space dividing system of claim 1 including connecting means fastened to a selected portion of at least one of the first and second stiles to define a joint between the connecting means and stile, said connecting means and said at least one stile being cooperatively configured to define an elongated cavity, and including a metallic bar disposed in said elongated cavity such that the metallic bar is in the path of a projectile which may enter the joint.

15. The space dividing system of claim 14 wherein the selected portion of the at least one stile to which the connecting means is fastened is recessed inwardly from a plane disposed through the joint.

16. The space dividing system of claim 15 wherein the recessed surface of the selected portion of the at least one stile is further recessed to define a surface which snugly receives and locates the elongated metallic bar.

17. The space dividing system of claim 1 including connecting means fastened to a selected portion of at least one of the first and second stiles to define a joint between the connecting means and stile, said connecting means and said at least one stile being cooperatively configured to define a tortuous path through the joint.

18. The space dividing system of claim 17 wherein the tortuous path includes a recess in the connecting means and an integral projection on the stile which projects into the recess.

* * * * *